US008425066B2

(12) United States Patent
Zeinstra

(10) Patent No.: US 8,425,066 B2
(45) Date of Patent: Apr. 23, 2013

(54) DOMESTIC APPLIANCE WITH AN INTEGRAL TRANSPARENT OR TRANSLUCENT WALL PORTION

(75) Inventor: Michiel Zeinstra, Blauwhuis (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 327 days.

(21) Appl. No.: 12/866,746

(22) PCT Filed: Feb. 6, 2009

(86) PCT No.: PCT/IB2009/050487

§ 371 (c)(1),
(2), (4) Date: Aug. 9, 2010

(87) PCT Pub. No.: WO2009/101557

PCT Pub. Date: Aug. 20, 2009

(65) Prior Publication Data

US 2010/0321922 A1 Dec. 23, 2010

(30) Foreign Application Priority Data

Feb. 15, 2008 (EP) ..... 08151476

(51) Int. Cl.
*F21V 33/00* (2006.01)

(52) U.S. Cl.
USPC ..... 362/89; 362/244; 362/248; 362/355

(58) Field of Classification Search ..... 362/89, 362/351, 355, 244, 247, 248, 227
See application file for complete search history.

(56) References Cited

U.S. PATENT DOCUMENTS

| | | | | |
|---|---|---|---|---|
| 5,384,658 | A * | 1/1995 | Ohtake et al. | 359/707 |
| 7,150,539 | B2 * | 12/2006 | Chen et al. | 362/235 |
| 2002/0181232 | A1 | 12/2002 | Martineau | |
| 2005/0138852 | A1 * | 6/2005 | Yamauchi | 40/582 |
| 2005/0183305 | A1 | 8/2005 | Hirata et al. | |
| 2006/0119542 | A1 | 6/2006 | Ho | |

FOREIGN PATENT DOCUMENTS

| | | | |
|---|---|---|---|
| EP | 1398650 | A1 | 3/2004 |
| EP | 1496488 | A1 | 1/2005 |
| WO | 2005093477 | A1 | 10/2005 |

* cited by examiner

*Primary Examiner* — John A Ward

(57) ABSTRACT

A domestic appliance (1) includes a housing or wall (6) and a wall portion (8). The portion is an integral part of the housing (6). The appliance has a display means (2) comprising a light source (10), a mask (2) and a diffuser (4). The housing (6) may be smoothly shaped to obtain an appealing design. A separate or standardized display may be perceived as a disruption of a smooth design of the appliance. To incorporate the display means (20) into the design the integral wall portion (8) is transparent and positioned between the diffuser (4) and the mask (2). An inner face of the wall portion (8) is directed to the mask (2). An outer face of the wall portion (8) is directed to the diffuser (4). A diffusing layer (32) included in the diffuser (4) is provided on the outer face of the integral wall portion (8).

20 Claims, 6 Drawing Sheets

DOMESTIC APPLIANCE WITH AN INTEGRAL TRANSPARENT OR TRANSLUCENT WALL PORTION

FIELD OF THE INVENTION

The invention is related to a domestic appliance having an integral wall portion and a display means comprising a light source, a mask and a diffuser for diffusing light emitted by the light source.

BACKGROUND OF THE INVENTION

Domestic appliances with a display means are generally known. Such domestic appliances, and in particular powered devices and instruments, are available in numerous designs and are fit to perform a large range of tasks varying from processing food to gently awakening a family. To provide information or feedback on the settings, mode of operation, condition and the like of such domestic appliances, a display may be provided. Besides a large variety in designs and applications, domestic appliances may be stored or positioned in countless ways. Hand-held domestic appliances like mixers and electric knives may be stored outside view, while stationary domestic appliances may alternatively be visibly positioned on e.g. a bed-side table or on a kitchen working top in case of an alarm clock and a coffee maker, respectively. Domestic appliances are required to have compact yet ergonomically desirable shapes and appealing designs, to comfortably assist in everyday chores while matching trendy styles in kitchen or bedroom furniture. Such a variety of requirements may pose the designer of home appliances for the challenging task of determining an optimal shape as a compromise between manufacturability, appeal and ease of handling of the application. A clear-cut example of such an antagonist set of motives is described here below with reference to a wake-up system for awaking a person by increasing light intensity. Such a system is known and includes an alarm clock coupled to a main light source supplied by variable electric power. The electric power and the intensity of the light emitted by the main light source are slowly, smoothly and gradually increased after the wake-up cycle is started. The time interval over which the light intensity increases is a predetermined period of time, or may be selectable by the user of the system. It will usually be in the range of thirty minutes to some hours. The final light intensity of the wake-up system may be selectable by the user, or has a predetermined value. At the end of the wake-up cycle the system may produce a sound signal to make sure that the person to be awaked knows that the wake-up cycle is over, or to awake that person in case he is still sleeping. Usually, such a system is provided with a display to provide the user with system information about the time, date and selectable or adjustable settings of the alarm clock, as indicated here above.

The known wake-up system is usually positioned near the bed on e.g. a bed-side table to enable the user to adjust the settings of the system within reach when being in bed. An appealing design of the known wake-up system, harmonizing with the style of the bedroom and the bedroom suite, is important; at the same time the wake-up system should be sufficiently compact to fit on the bed-side table, without occupying a major part of e.g. the bed-side table.

A relatively large portion of the power supplied to the main light source is converted into heat. In known wake-up systems an incandescent lamp of at least 70 W, or even more than 100 W is applied as main light source. Measures have to be taken for cooling the system, whereby the cooling is preferably performed by means of free convection of ambient air, in order to avoid noise that may be caused by forced cooling. For that reason, the dimensions of such wake-up systems are relative large, which conflicts with the requirements of compactness of the wake-up system and of sufficient freedom to realize an appealing design of the wake-up system.

A separate display is frequently positioned in or on the housing or a wall, more particularly a wall portion of the housing, of a domestic appliance, disturbing the uniformity and integrity of the design of said housing or wall and necessitating the need for special adaptations to attach such a display component to the housing or the wall of the product. Such a housing or wall may comprise a smoothly or doubly curved shell structure, emphasizing or expressing a trend in product design. Alternatively, the design of the housing or the wall of the appliance may be according to an angular or rectilinear design.

Today's displays, such as LCD- and OLED-displays are usually mounted into or onto the housing or a wall of the appliance. If the display is mounted into the housing the housing may have a window or may be partly cut away to accommodate the display. The accommodation of the display leads to an interruption of the surface of the product housing or of a wall or wall portion thereof. Such interruption may be perceived as a disturbance of its appearance.

Displays using LED's, a mask and a diffuser are commonly used devices which are sold by many manufacturers. In such known displays a protecting and transparent sheet or layer is covering the level of the diffuser of the display, i.e. the level of the display where the information is indicated. These known displays are usually mounted on or assembled into domestic appliances such that the surface of the transparent layer is at the same level as the surface of housing of the product domestic appliance. Hence, a difference in level between the surface of the product housing and the level of the display where the information is indicated will result. This difference in level is visible and will, if detected, be perceived as emphasizing a disturbance of the smoothness, uniformity and integrity of the housing of the product or the appliance. Furthermore, such a difference in level emphasizes the presence of the display. A too pronounced presence of a display decreases the appeal of the product. A too pronounced presence of the display on top of the above described interruption of the product surface by the display may even be perceived as a disfigurement of the product design.

SUMMARY OF THE INVENTION

It is an object of the invention to provide a domestic appliance of the kind set forth in the opening paragraph, which has a display means that is smoothly included into the design of the domestic appliance.

According to the invention this object is realized in that the integral wall portion of the domestic appliance is transparent or translucent for light of the light source and positioned between the diffuser and the mask, wherein the integral wall portion has an inner face directed to the mask and an outer face directed to the diffuser, wherein the diffuser comprises a diffusing layer provided on the outer face of the integral portion.

Known displays, such as LCD- and OLED displays, which are usually mounted as separate components into the wall or the housing of appliances, may have a transparent or translucent window covering the display. Instead of the window of a display which is separate from and not integrated into the wall of the appliance, the invention proposes a transparent or translucent wall at the position of the appliance where the information should be displayed. The transparent or translucent wall portion forms an integrated or integral part of the structure of the appliance and may be formed, shaped, modeled or manufactured at the same time or during the same operation as the rest of the wall of the appliance, enabling continuity in the surface and in the continuity of the curvature of the surface of the wall of the appliance. On one side of the transparent or translucent wall portion the mask of the display means is provided. The mask screens off the light emitted by the light source of the display means. On the other side of the transparent or translucent wall portion the display means has its diffuser. The diffuser diffuses the light emitted by the light source light into a patch of light. The mask blocks part of the light emitted by the light source while another part of the light emitted by the light source passes through the mask and forms a bundle of light having a cross-section of a shape which may e.g. be determined by the mask or a diaphragm. The light bundle or a part thereof propagates through the transparent or translucent wall portion of the appliance and reaches the diffuser at the opposite side of the integral wall portion, where it can diffuse as a patch of light that constitutes part of the information to be displayed. The said transparent wall portion being integrated into or integral to the domestic appliance, as part of for example the product housing, a cover enveloping drive means of the appliance or some shell structure defining the outer surface of the appliance, the design of the appliance does not necessarily have to be interrupted. Because the display means does not disrupt the continuity of the surface nor disrupts the continuity of the curvature of the surface of the wall of the appliance according to the invention, the display means is smoothly included into the design.

The diffusing layer of the diffuser is provided on the outer face of the integral portion. Light emitted by the light source, propagates through the transparent wall portion and is diffused by said layer on the outer face of the integral wall portion. Being diffused on the outer face of the integral wall portion, the light is perceived as coming from or originating at said outer face. Hence, the information that is displayed by the light which is diffused on the outer face is perceived as being painted or projected on the outer face of the domestic appliance, because the wall portion is an integral wall portion of the appliance. No level difference is perceived between the surface of the appliance and the level on which the information is displayed, which further emphasizes that the display means is smoothly included in the design and appearance of the appliance and of its surface.

An additional advantage of the invention is that the curvature of the wall may be optimized to enable a compact design. When mounting a separate display into the housing or a wall of the appliance, the curvature of the wall portion where the display is mounted should be adapted to the curvature of the display to have an optically attractive continuation of the curvature of the wall portion near the display into the curvature of the display. Separate displays may not be available at low cost with a prescribed or desired curvature along their surface. These displays may be shelve-articles having a rather flat front surface. To adapt the curvature of the wall portion of the appliance to such a flat front surface may imply that the curvature of the wall portion is to be reduced to match the low curvature of the standard separate display. A reduced curvature of the wall portion results in increased dimensions and decreased compactness of the appliance.

An additional advantage is that the information displayed by the light which is diffused on the outer face of the appliance is perceived as being floating on the surface of the appliance. Diffusing the light on the outer side of the appliance from the inside of the appliance without disruption of the outer product surface creates the illusion that information is touchable and floating on the outer product surface. Such an esthetic effect can be used to the advantage of a design trend or style.

In an advantageous embodiment of the invention the diffusing layer is a lacquering layer.

The lacquering layer covers the domestic appliance or a part thereof. By using a lacquering layer as a diffusing layer the display means may be totally received or included into the product design. The lacquering layer may cover the product housing and the display means at the same time, which emphasizes a smooth transition between the surface of the product or wall and the surface where information can be displayed.

In an advantageous embodiment of the domestic appliance according to the invention, one or more refraction elements are provided on the inner side, i.e. the mask side, of the transparent or translucent wall portion.

Light emitted by the light source may be bundled by the refraction elements such, that scattering of the light inside the transparent wall portion is provided. Scattering of the light emitted by the light source may cause blurring of the image provided after diffusion of the light in the diffuser. The refraction elements may be designed such, e.g. by ray-tracing, that scattering of light inside the transparent wall portion is optimized. By provision of the refraction elements on the mask side of the transparent wall portion, these elements may be kept apart and not included in the product surface. Hence, the product appearance will not be adversely affected by provision of refraction elements on the mask side of the transparent wall portion. The refraction elements can be designed to obtain a converging bundle, such that the area of a cross-section of the bundle near the diffuser is smaller than the area of a cross-section of the bundle near the inner side or the mask side of the wall portion. This effect of reduction can be advantageously used to avoid overlap of symbols displayed by the diffuser.

In an advantageous embodiment of the domestic appliance according to the invention the wall portion has the one or more refraction elements.

Refraction elements act as lenses, as explained above, to bundle the light emitted by the light source and to avoid any excessive scattering inside the transparent wall portion. The lenses or refractive elements can be integrated in e.g. the mould of the housing to avoid addition of extra components or parts. The housing may be molded in one operation together with the refraction elements. Being included in the transparent or translucent or semi-transparent wall portion and comprising similar transparent or translucent or semi-transparent material as the wall portion, no additional layer is present between the one or more refraction elements and the wall portion. Such an additional layer may cause scattering of emitted light prior to diffusion of the light in the diffuser.

In an advantageous embodiment of the domestic appliance according to the invention the present one or more refraction elements are arranged to propagate light emitted by the light source into a bundle which is transmitted by the wall portion, the bundle being perpendicular to the diffuser.

As the bundle is perpendicular to the diffuser, secondary reflections are avoided. Such secondary reflections should cause scattering of the emitted light and blurring of sides of the image provided by the display means.

In an advantageous embodiment of the domestic appliance according to the invention the mask is positioned against the transparent wall portion.

As the mask is positioned against the wall portion, no gap exists between the mask and the wall portion. Avoidance of such a gap prevents that light emitted by the light source enters the transparent wall portion in an uncontrolled and inclined direction with respect to the mask side surface of the transparent wall portion. If the light enters the surface at an inclination further scattering inside the transparent wall portion may result. Furthermore, the mask function may be affected in that neighboring parts of the display means or neighboring refraction elements receive light from an unintended light source.

In an advantageous embodiment of the domestic appliance according to the invention a diaphragm is positioned between the mask and the wall portion.

Light emitted by the light source can be reflected by the mask. In such a case this reflected light may be projected to the diffuser, whereby the illuminated segment of the diffuser may exceed a desired size of a segment of the display means. This aspect of mask reflection results to blurring of the image provided by the display means. The light emitted by the light source may also be refracted by the wall portion and cause scattering. Refraction and scattering in the wall portion increase with an increasing angle of incidence of the light entering the wall portion. Application of a diaphragm may alleviate these effects. The shape of the diaphragm will be projected or magnified on the diffusing layer on the wall portion, e.g. the outside of the product housing. Where a converging refraction element is applied in combination with the diaphragm the projected shape of the diaphragm can also be reduced after projection on the diffusing layer to avoid overlapping symbols or to obtain a higher resolution of the displayed symbols.

In an advantageous embodiment of the domestic appliance according to the invention the diaphragm comprises a foil attached to the wall portion.

The foil may comprise segments and symbols being printed on the foil. Such a printed foil can be conveniently attached, e.g. by a glue, to the mask side of the wall portion, e.g. the inside of the product housing.

In an advantageous embodiment of the domestic appliance according to the invention the diaphragm is printed on the mask-side surface of the wall portion.

An efficient method to produce the domestic appliance comprises a step wherein the diaphragm is printed or spray-painted on the mask-side of the wall portion, e.g. the inside of the product housing.

In an advantageous embodiment of the domestic appliance according to the invention the diaphragm is included in the mask.

The applied mask comprises holes to enable light emitted by the light source to be incident on the wall portion. By decreasing the size of the holes in the mask it may be acquired that the light emitted by the light source is projected to the diffuser in a desired shape. The shape of the mask holes may be determined to obtain a desired shape of the projection of the emitted light on the diffuser.

In an advantageous embodiment of the domestic appliance according to the invention the mask has slanted surfaces to reflect the light emitted by the light source away from the transparent wall.

Light emitted by the light source and hitting the mask-side surface of the transparent wall portion may be reflected at the mask-side surface of the transparent wall portion if the angle of incidence significantly deviates from a straight angle. Furthermore, light entering the transparent wall portion under an angle which significantly differs from a straight angle may be refracted inside the transparent wall portion. These phenomena may cause blurring of the image provided by the diffuser. By provision of the mask with slanted surfaces these effects may be mitigated. The sides of the mask holes may be chamfered such that the light emitted by the light source and reflected at the chamfer of the mask hole is reflected away from the transparent wall portion. If the chamfer or slanted surface would be absent such light would hit the surface of the transparent wall portion under a disadvantageous angle, causing reflections, refractions, scattering and finally a blurred image provided by the display means.

In an advantageous embodiment of the domestic appliance according to the invention the mask has light absorbing properties.

As explained here above, it is advantageous to project the light emitted by the light source sufficiently perpendicular to the surface of the transparent wall portion to avoid reflections, refractions, scattering and finally a blurred image provided by the display means. Light which is reflected by the sides of the mask holes may not be projected sufficiently perpendicular to the surface of the transparent wall portion. By the provision of light absorbing properties these reflections may be largely avoided.

The invention may be advantageously applied in a wake-up system.

The requirements which have to be fulfilled by a wake-up system comprise integrity of design and compactness as explained here above. Providing an enlarged degree of design freedom, the invention relaxes the set of antagonist requirements, which system is also part of the invention.

In an advantageous embodiment of the invention the wall portion is part of a main housing of the appliance and the diffusing layer completely covers the entire outer surface of the main housing.

The diffusing layer completely covering the entire outer surface of the main housing, the display can be completely integrated into the product housing and the design of the product housing.

DETAILED DESCRIPTION OF THE INVENTION

Figure 1:
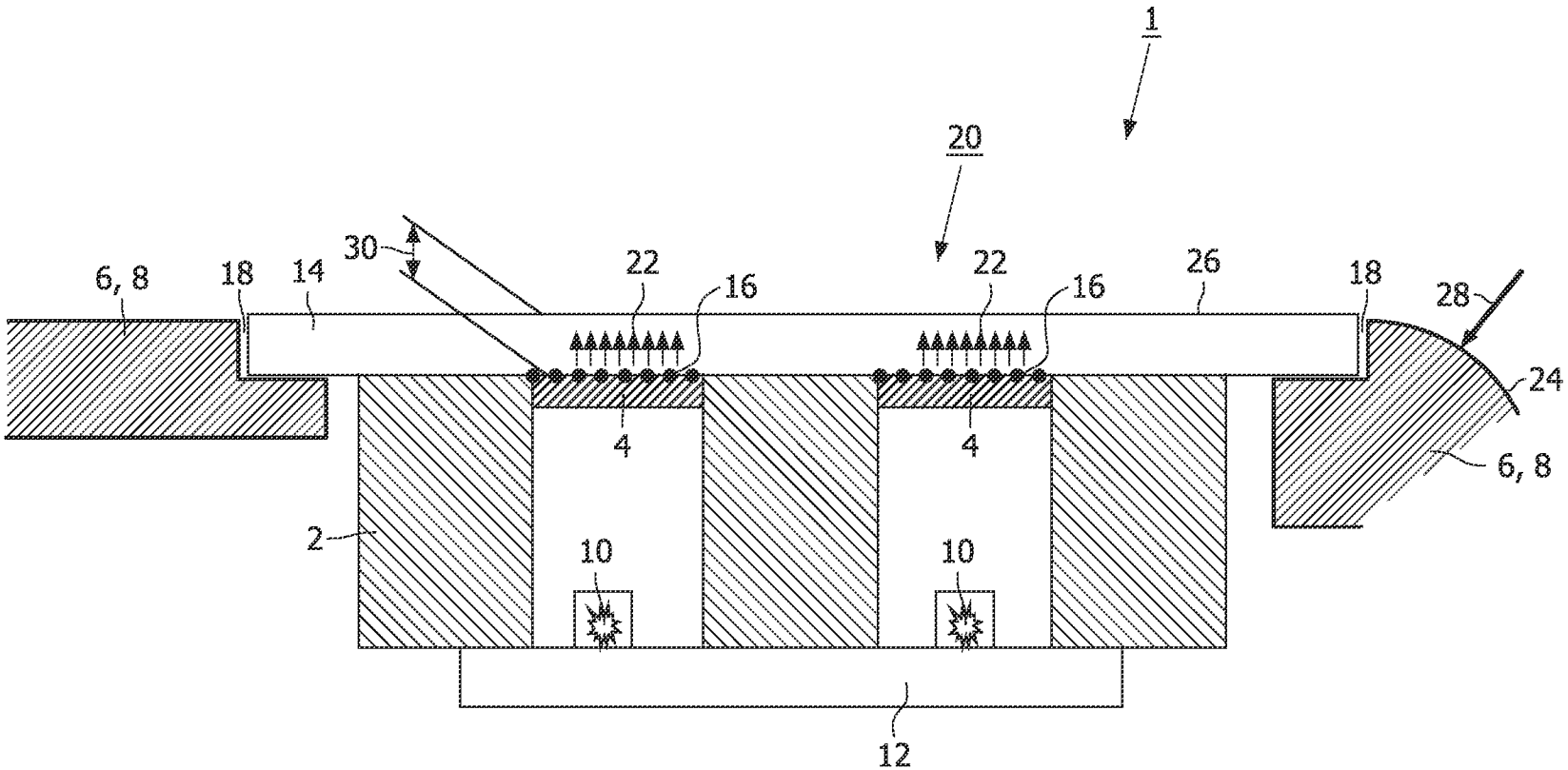
FIG. 1 is a schematic side view of a known appliance.

In this description, identical or corresponding parts, portions or components have identical or corresponding reference numerals. The description shows exemplary embodiments, which serve merely as an illustration. The exemplary embodiments should not be construed to be limitative in any manner.

FIG. 1 schematically depicts a side view of a section of a known display 20 mounted into the housing 6 of a domestic appliance 1. The housing 6 comprises a wall portion 8 having a recess 18. The display 20 is mounted or provided into the recess 18. The display 20 includes a display cover 14 having dimensions that correspond to the dimensions of the recess 18 to enable the mounting of the display 20 into the product housing 6. The display 20 comprises a display mask or mask 2, light sources 10 and diffusers 4. The light sources 10 may for example be LED's. The light sources 10 are mounted to a board 12. The diffusers 4 have diffuser surfaces 16 for diffusing light 22 emitted by the light sources 10. The diffusers 4 are covered and protected by the display cover 14. The display 20 is of a kind which may be generally available as a shelf article. Such separate displays may be available in a range of standardized dimensions, colors and styles. A preferred way of fitting or mounting such a separate component or display 20 into the product housing 6 may be such that the product surface 24 and the surface 26 of the display cover 14 are positioned in the same level after mounting the display 20 into the housing 6. With such a way of fitting a smooth surface is obtained.

To mount such standardized displays into the housing of a product may result in a difference in level between the product surface 24 and the diffuser surface 16. This difference in level is indicated by distance 30 in FIG. 1. A depth will be observed or perceived when looking at the information provided by the display 20, because the light emitted by the light sources 10 is diffused at surface 16. This perceived difference in level is an interruption of a smooth product surface. Furthermore, the display 20 usually has a color which differs from the color of the product housing 6. If the display cover 14 is transparent and the product housing 6 is opaque, the transition between the display 20 and the product surface 24 may be marked. Such a noticeable transition is to the detriment of the integrity of the design of the product.

The design of a product may include a radius of curvature 28, which may be interrupted near the position where the display is mounted. Such interruptions are perceived as a disruption of a nice and smooth product appearance. Because such disruptions of product appearance are to be avoided, the mounting of a standardized and separate display is a limitation of freedom of design.

Figure 2:
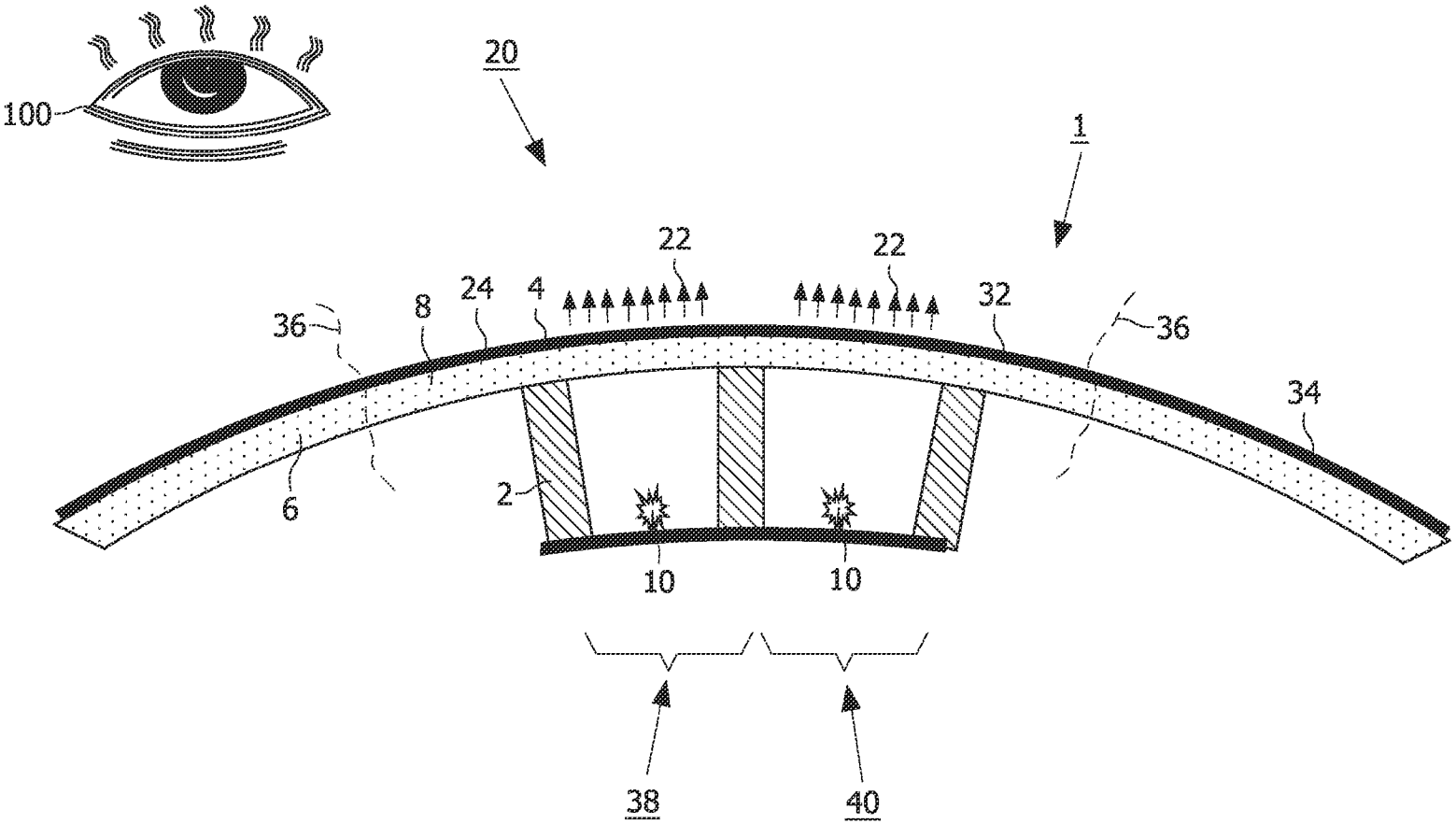
FIG. 2 is a schematic side view of a domestic appliance according to the invention.

FIG. 2 is a side view of an embodiment of the domestic appliance 1 according to the invention. The domestic appliance has a display means 20. The appliance 20 is provided with a wall or housing 6. The wall 6 has a transparent integral wall portion 8. In FIG. 2 the transparent wall portion is schematically indicated by the dashed lines 36. It is an integral portion in the sense that it is a part of the product structure, e.g. in the case where the product housing is a monolithic or monocoque structure such integral portion is comprised by the monolithic or monocoque structure, respectively. The display means 10 includes a diffuser 4 for the diffusion of light emitted by light sources 10. In this embodiment the diffused light 22 is emitted at or near the surface 24 of the transparent wall portion 8 of the product housing 6. A mask 2 is placed as an opaque border or pattern between and around the light sources 10 to enable exposure of specified portions of the diffuser 4 by the right light source and to prevent cross-talk between nearby display units 38 and 40, each display unit 38 and 40 having its individual light source 10. Thus the mask 2 prevents that the diffuser 22 which belongs to display unit 40 is illuminated when only the light source 10 of display unit 38 is switched on and vice versa.

Figure 3:
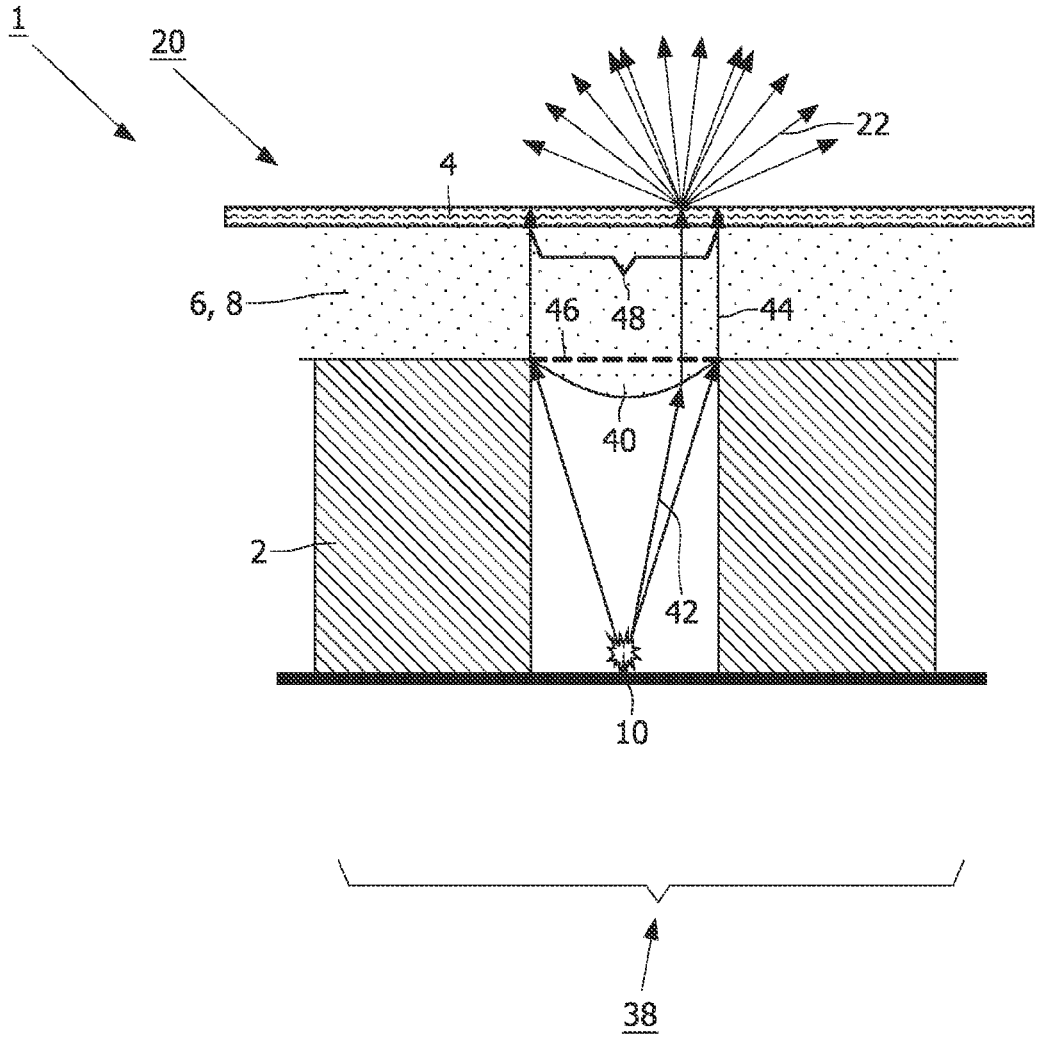
FIG. 3 is a schematic side view of a domestic appliance according to the invention.

In the embodiment of FIG. 2 the applied diffusing layer 32 is a lacquering layer 34. Hence, display means 20 may be smoothly incorporated in the color provided to the housing 6 of the appliance 1. The diffusing layer 32 being provided to the surface 24 of the housing 6, there exists no change in any radius of curvature of the product. This continuity of curvature emphasizes a well considered and mature product design. The display 20 displays information in the form of light 22 which originates at the surface 24 of the product 1. When observing the domestic appliance 1 the user, schematically depicted by an eye 100, perceives the information which is displayed as directly touchable, palpable or tangible and as manifestly located on the surface 24 of the housing 6 of the domestic appliance 1. The curvature of the display means 20 conforms to and is a smooth continuation of the curvature of the domestic appliance 1. Hence, the display means according the invention realizes an esthetic effect which is advantageously integrated into a smooth product design. In FIG. 2 the appliance 1 has a convex surface 24 like the exterior of a sphere, i.e. a surface or boundary that curves or bulges outward to the user 100. However, it is conceivable that surface 24 is concave and that the wall portion is of considerable thickness. In this a design it is advantageous to apply refraction elements (40) (FIG. 3). Such refraction elements (40) can be used to reduce the image or symbol displayed at the surface 24 to avoid overlap between symbols.

In FIG. 3 an embodiment of a display unit 38 of a display means 20 of a domestic appliance 1 according to the invention is schematically depicted. The unit 38 has a mask 2 and a light source 10 which emits light 42 towards a transparent integral wall portion 8 of the domestic appliance. The display unit 38 has a refraction element 40, such as a lens. The refraction element 40 is attached to the transparent integral wall portion 8. The refraction element 40, e.g. a lens, may be a separate element or it may be included in the transparent portion 8. In the former case the separation between the lens 40 and the wall portion 8 is indicated by a dashed line 46. In the latter case the refraction element 40 may be molded in a single mold together with the wall or housing 6 of the appliance 1 and no additional parts have to be added to provide for the lens 40. The lens 40 refracts the light 42 into a bundle of light 44 which propagates through the transparent wall portion 8. After refraction the light 44 will be bundled such that a defined area 48 of a diffuser 4 is irradiated. The lens 40 may be designed such that the light 46 is irradiated substantially perpendicular to the irradiated area 48 of the diffuser 4. Design strategies to accomplish such irradiation are generally known, e.g. ray-tracing.

Figure 4:
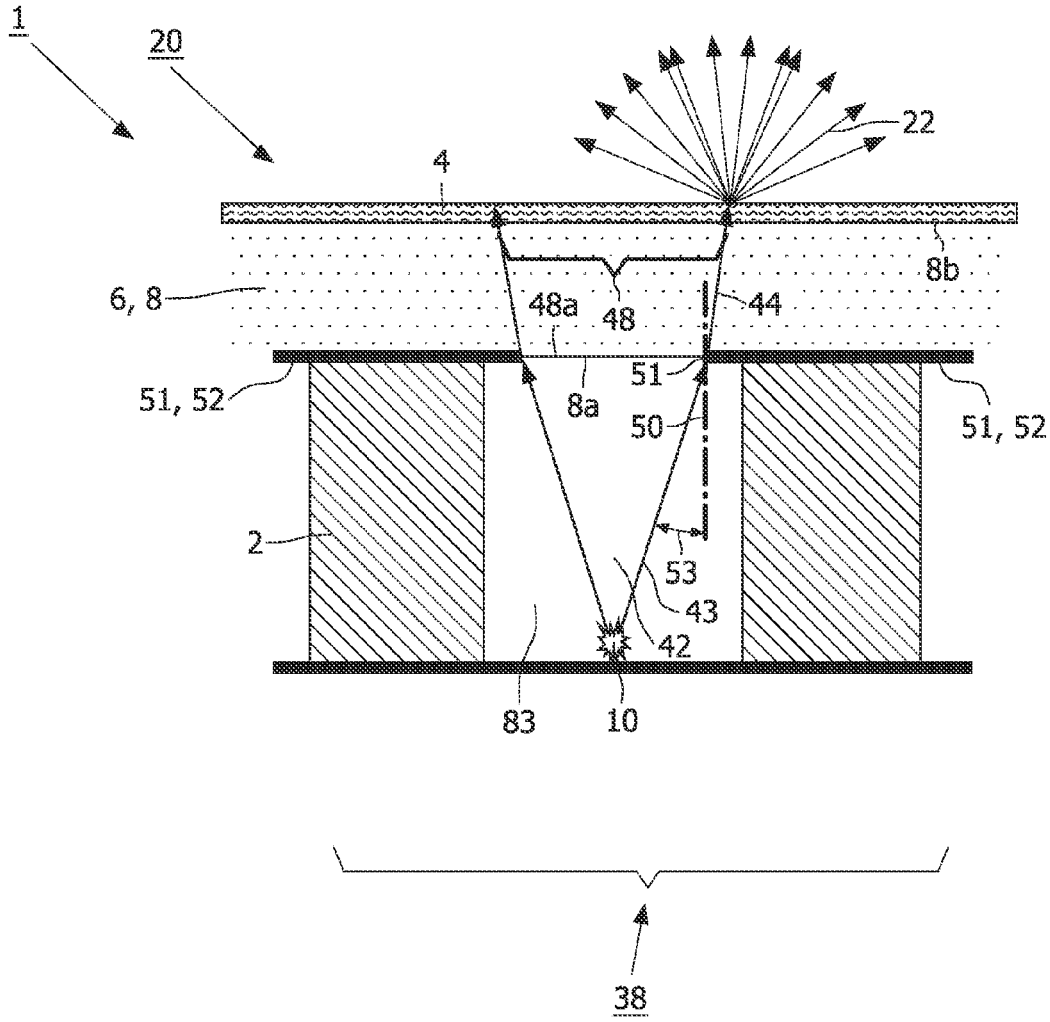
FIG. 4 is a schematic side view of a domestic appliance according to the invention.

In FIG. 4 an embodiment of a display unit 38 of a display means 20 of a domestic appliance 1 according to the invention is schematically depicted. A diaphragm 52 is positioned between a mask 2 and a transparent wall portion 8. The transparent wall portion 8 is an integral part of a housing 6 of the domestic appliance 1, arranged similarly as the previously described embodiments. The unit 38 has a light source 10 which emits light 42 towards the transparent integral wall portion 8 of the domestic appliance 1. An exterior ray of light 43 is incident on an edge 51 of diaphragm 52 under an angle of incidence 53 with a normal 50 to the mask side surface, i.e. the inner face, **8*a* of the transparent wall portion 8. By refraction a divergent bundle of light 44 is formed inside the wall portion 8. The bundle of light 44 irradiates a diffuser 4 and light 22 is emitted by the diffuser over an irradiated area 48. The size of the irradiated area will be larger than the size of the opening 48*a* in the diaphragm 52 between the edges 51. The shape of an opening in the diaphragm is projected or magnified on the diffuser 4 on the outside of the housing 6. The diaphragm 52 of domestic appliance 1 may have a foil 51 which has printed segments or symbols in the form of openings 48*a* of a predetermined shape. As illustrated according to FIG. 4, the shape of a diaphragm opening 48*a* is projected on the irradiated area 48 into a displayed symbol or part of a symbol. The shape of the opening in the diaphragm 48*a* may be determined according to known techniques to obtain a desired shape of the symbols displayed by the display unit 38. Alternatively, a diaphragm may be printed on the mask-side surface 8*a* of the transparent wall portion 8. The wall portion 8 may be lacquered on the diffuser side, i.e. the outer side 8*b*** of the wall portion 8, to provide the diffuser 4 to the transparent wall portion 8. Alternatively, a diaphragm 52 may be included in the mask, e.g. by decreasing the dimensions 82 (see FIG. 5) of the cross-section of the holes of the mask to arrive at a predetermined shape where the mask touches the mask side 8*a* of the transparent wall portion 8. Advantageously, the above described functionality of foil 51 (FIG. 4) may be incorporated into an inner housing 1051 as will be explained below according to FIG. 6.

Figure 5:
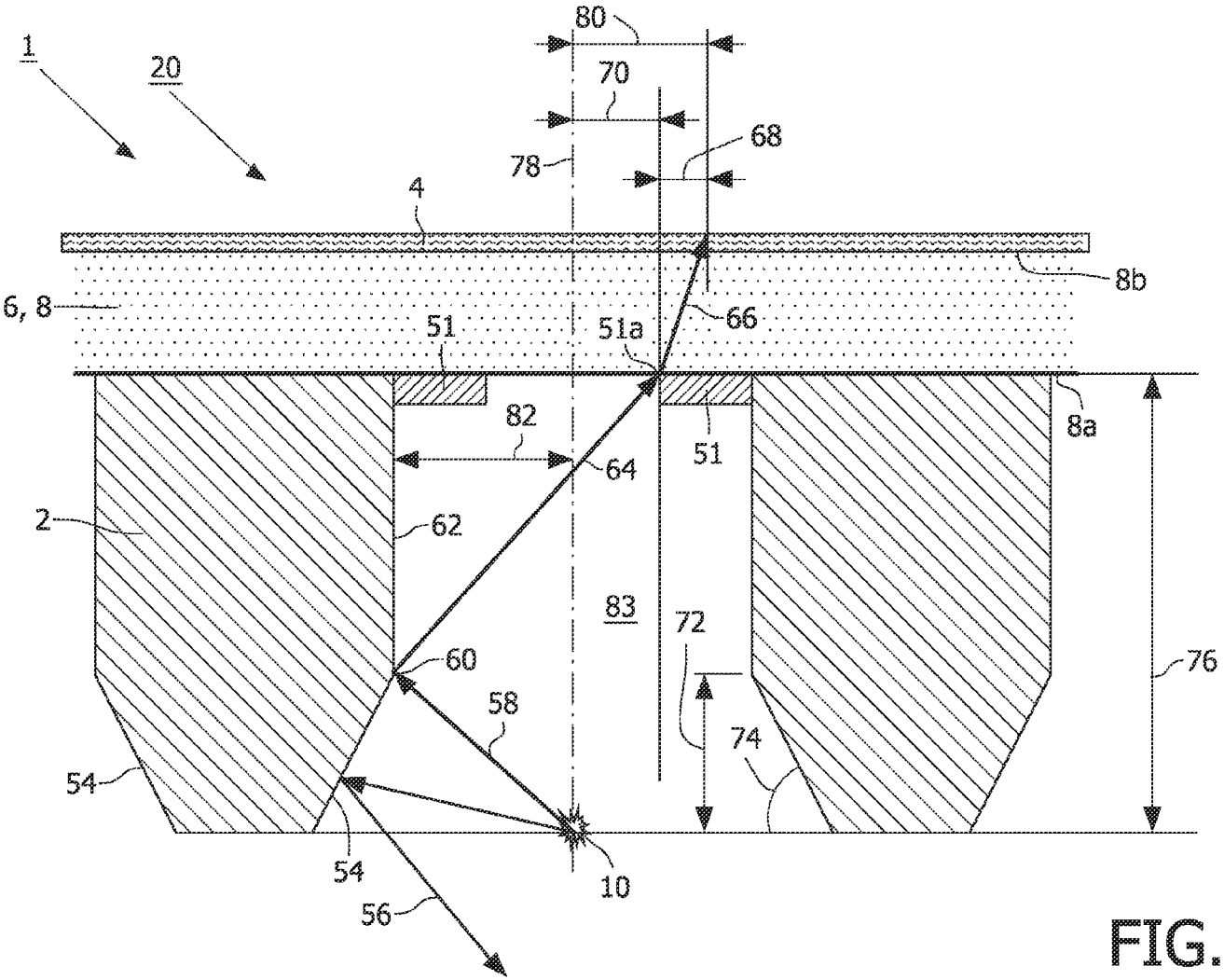
FIG. 5 is a schematic side view of a domestic appliance according to the invention.

In FIG. 5 an embodiment of a domestic appliance 1 and a display means 20 according to the invention are schematically depicted. A diffuser 4 is provided on an outer side 8*b* of an integral wall portion 8 of a housing 6 of the domestic appliance 1. A mask 2 having slanted surfaces 54 is provided on an inner side 8*a* of the wall portion 8. The slanted surfaces 54 reflect light emitted by a light source 10 away from the transparent wall portion 8. The light which is reflected away is indicated by an arrow 56. A beam of light 58 emitted by the light source 10 is reflected near a transition 60 of one of the slanted surfaces 54 to a surface 62 of a mask hole 83. The surface 62 is oriented perpendicular to the mask side surface 8*a* of the wall portion 8. A reflection 64 of beam 58 is incident on the integral wall portion 8 and will be refracted into a beam 66 which propagates through the transparent material of the wall portion 8. Beam 66 diffuses at the diffuser 4. Beam 58 is the utmost reflected beam that reaches the transparent wall portion 8. A beam that hits the slanted surface 54 in a position below transition 60 will be reflected away from the transparent wall portion 8 similar to beam 56. A diaphragm 51 is provided and has the effects as described here above, according to FIG. 4. The light source 10 is positioned on a center line 78 of the mask hole 83. Reflection 64 is incident at a distance 70 from the center line 78. The refracted beam 66 diffuses at a distance 68 from the position where beam 64 is incident, i.e. near an edge 51*a* of diaphragm 51. As a result the transition 60 is projected at a projection distance 80. Projection distance 80 is the sum of distance 68 and distance 70. The projection distance 80 is a function of height 72 and angle 74 of the slanted surface 54, thickness of the mask 76 and distance 82. By properly dimensioning of the slanted surfaces 54 the dimensions of the irradiated area of the diffuser 4 and the shape of the display symbols may be determined, e.g. by ray-tracing techniques. On top of beam 64, light emitted by the light source 10 will directly propagate from the light source 10 to the edge 51*a* of the diaphragm 51. Said directly propagated light has an angle of incidence which is less than the angle of incidence of beam 64. Hence, the projection of the directly propagated light will be closer to center line 78 than beam 66. It is also possible to apply a combination of the above described technical features, such as any combination of a refraction element, a slanted surface and a diaphragm.

To avoid reflections on side walls 62 of the mask 2 the mask 2 may be provided with light absorbing properties in any embodiment of the invention. As an example this is illustrated according to the embodiment as schematically depicted in FIG. 5. The walls 62 being provided with light absorbing properties, beam 58 is at least partly absorbed. The portion of beam 58 which is reflected forms reflected beam 64. Reflected beam 64 is of an intensity which is lower than the intensity of light which propagates directly from the light source to the mask side 8*a*. The reduction of the intensity of the reflected beams can be advantageously used to obtain sharpness of the displayed symbols and to avoid blurry images.

Figure 6:
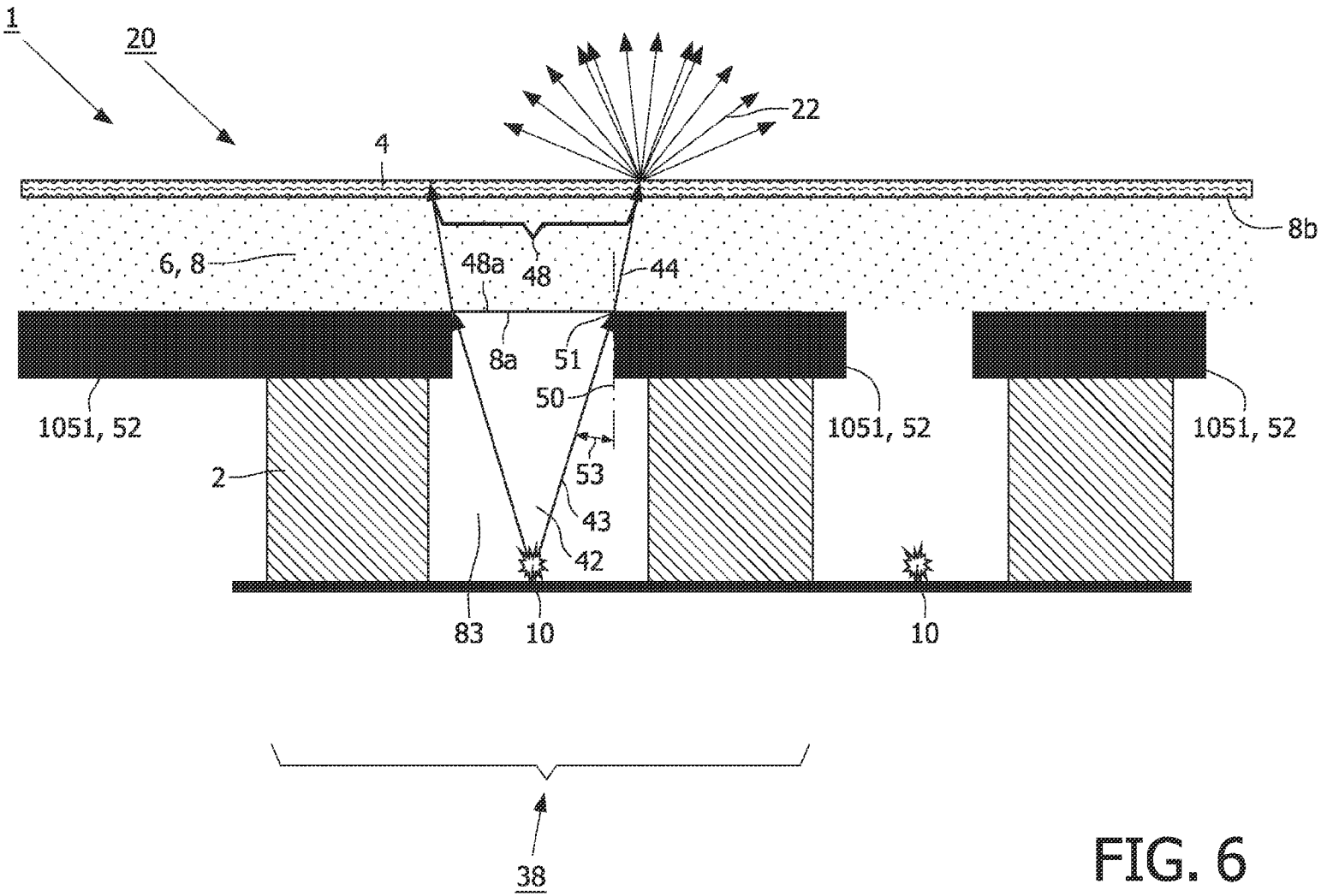
FIG. 6 is a schematic side view of a domestic appliance according to the invention.

In FIG. 6 an embodiment of a display unit 38 of a display means 20 of a domestic appliance 1 according to the invention is schematically depicted. A diaphragm 52 is positioned between a mask 2 and a transparent wall portion 8. The transparent wall portion 8 is an integral part of an outer housing 6 of the domestic appliance 1, arranged similarly as the previously described embodiment as schematically depicted in FIG. 4. The unit 38 has several light sources 10 which emit light 42 towards the transparent integral wall portion 8 of the domestic appliance 1. In the embodiment as depicted in FIG. 6 the appliance 1 has an inner housing 1051. The inner housing 1051 forms the diaphragm 52 of domestic appliance 1, i.e. the functionality of the foil 51 of the embodiment as depicted in FIG. 4 is now incorporated into the inner housing 1051. Incorporation of the diaphragm into the inner housing 1051 of the appliance 1 brings the advantage that symbols and segments can be added to the inner housing by e.g. a laser or directly into a mould for producing the inner housing 1051. In case a foil 51 according the embodiment of FIG. 4 is used, the color of the foil should preferably match the color of other visible parts of the appliance 1. The part of the appliance 1 where the foil 51 according to FIG. 4 is applied should preferably not be discernable from the rest of the appliance 1 in order to maintain a smooth and nice appearance of the appliance 1. By incorporating the diaphragm function into the inner housing 1051 the foil 51 can be omitted, whereby a possible color difference originating from such foil over the surface of the appliance near the display is avoided.

By using the inner housing 1051 as the diaphragm 52 of the display it is avoided that such a display sticks out of the inner housing 1051, because the diaphragm 52 and the inner housing 1051 are one and the same part, i.e. there exists no hard transition between the inner housing 1051 and the diaphragm 52. In case a separate diaphragm is used it may happen that due to differences in tolerances the display or its separate diaphragm sticks out of the inner housing 1051. This may cause disturbing visible reflection, shading and the like which affect the smooth appearance of the appliance 1. A special embodiment of the domestic appliance according to the invention comprises a part of an inner housing 1051 of the appliance 1.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein a combination is applied of the above described technical features, such as any combination of a refraction element, a slanted surface and a diaphragm. A diaphragm may be omitted to obtain a vague or hazy shape of the displayed symbols to emphasize a desired style or trend.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single display unit may fulfill the functions of several items recited in the claims. The mere fact that certain measures are recited in mutually different dependent claims does not indicate that a combination of these measured cannot be used to advantage. Any reference signs in the claims should not be construed as limiting the scope.

The invention claimed is:

1. A domestic appliance comprising:

a wall portion that is an integral part of a structure of the domestic appliance; and a display means comprising a light source, a mask having a mask hole, and a diffuser for diffusing light emitted by the light source through the mask hole, wherein the wall portion of the domestic appliance is (i) translucent or transparent for light of the light source and (ii) positioned between the diffuser and the mask, wherein the wall portion has an inner face directed to the mask and an outer face directed to the diffuser, wherein the diffuser comprises a diffusing layer provided on the outer face of the wall portion, and wherein the mask, via the mask hole, blocks part of the light emitted by the light source while another part of the light emitted by the light source passes through the mask.

2. The domestic appliance according to claim 1, wherein the diffusing layer is a lacquering layer.

3. The domestic appliance according to claim 1, wherein one or more refraction elements are provided on the inner face of the wall portion.

4. A domestic appliance according to claim 3, wherein the wall portion includes the one or more refraction elements.

5. The domestic appliance according to claim 3, wherein the one or more refraction elements are arranged to propagate light emitted by the light source into a bundle which is transmitted by the wall portion, the bundle being perpendicular to the diffuser.

6. The domestic appliance according to claim 1, wherein the mask is positioned against the inner face of the wall portion.

7. The domestic appliance according to claim 1, wherein the mask has slanted surfaces to reflect light emitted by the light source away from the wall portion.

8. The domestic appliance according to claim 1, wherein the mask has light absorbing properties on side walls of the mask hole of the mask.

9. The domestic appliance according to claim 1, wherein the domestic appliance is a wake-up system for awaking a person by increasing light intensity.

10. The domestic appliance as claimed in claim 1, wherein the wall portion is part of a main housing of the appliance and wherein the diffusing layer completely covers the entire outer surface of the main housing.

11. A domestic appliance comprising:

a wall portion that is an integral part of a structure of the domestic appliance; and a display means comprising a light source, a mask, and a diffuser for diffusing light emitted by the light source, wherein the wall portion of the domestic appliance is translucent or transparent for light of the light source and positioned between the diffuser and the mask, wherein the wall portion has an inner face directed to the mask and an outer face directed to the diffuser, wherein the diffuser comprises a diffusing layer provided on the outer face of the integral wall portion, and wherein a diaphragm is positioned between the mask and the wall portion.

12. The domestic appliance according to claim 11, wherein the diaphragm comprises a foil attached to the wall portion.

13. The domestic appliance according to claim 12, wherein the foil has printed segments or symbols.

14. The domestic appliance according to claim 11, wherein the diaphragm is printed on the inner face of the wall portion.

15. The domestic appliance according to claim 11, wherein the diaphragm is included in the mask.

16. The domestic appliance according to claim 11, wherein the mask has slanted surfaces to reflect light emitted by the light source away from the wall portion.

17. The domestic appliance according to claim 11, wherein the mask has light absorbing properties on side walls of the mask.

18. The domestic appliance according to claim 11, wherein the domestic appliance is a wake-up system for awaking a person by increasing light intensity.

19. The domestic appliance as claimed in claim 11, wherein the wall portion is part of a main housing of the appliance and wherein the diffusing layer completely covers the entire outer surface of the main housing.

20. The domestic appliance according to claim 11, wherein one or more refraction elements are provided on the inner face of the wall portion.

* * * * *